US007314545B2

(12) United States Patent
Karas et al.

(10) Patent No.: US 7,314,545 B2
(45) Date of Patent: Jan. 1, 2008

(54) DESULFURIZATION PROCESS

(75) Inventors: Lawrence J. Karas, West Chester, PA (US); Roger A. Grey, West Chester, PA (US); Michael W. Lynch, West Chester, OH (US)

(73) Assignee: Lyondell Chemical Technology, L.P., Greenville, DE (US)

( * ) Notice: Subject to any disclaimer, the term of this patent is extended or adjusted under 35 U.S.C. 154(b) by 536 days.

(21) Appl. No.: 10/754,952

(22) Filed: Jan. 9, 2004

(65) Prior Publication Data

US 2005/0150156 A1 Jul. 14, 2005

(51) Int. Cl.
*C10G 45/00* (2006.01)

(52) U.S. Cl. ..... 208/208 R; 208/240

(58) Field of Classification Search ..... 585/14; 208/208 R, 428, 240, 196
See application file for complete search history.

(56) References Cited

U.S. PATENT DOCUMENTS

| | | | | |
|---|---|---|---|---|
| 3,565,793 | A | 2/1971 | Herbstman et al. | 208/208 |
| 3,816,301 | A | 6/1974 | Sorgenti | 208/208 |
| 4,367,342 | A | 1/1983 | Wulff et al. | 549/529 |
| 5,759,945 | A | 6/1998 | Carroll et al. | 502/242 |
| 5,985,136 | A | 11/1999 | Brignac et al. | 208/216 |
| 6,011,162 | A | 1/2000 | Han et al. | 549/529 |
| 6,114,552 | A | 9/2000 | Han et al. | 549/529 |
| 6,187,934 | B1 | 2/2001 | Tsuji et al. | 549/529 |
| 6,323,147 | B1 | 11/2001 | Yamamoto et al. | 502/64 |
| 6,368,495 | B1 * | 4/2002 | Kocal et al. | 208/240 |
| 6,402,939 | B1 | 6/2002 | Yen et al. | 208/196 |
| 7,144,499 | B2 * | 12/2006 | Han et al. | 208/208 R |

FOREIGN PATENT DOCUMENTS

| | | |
|---|---|---|
| EP | 0 345 856 | 5/1989 |
| EP | 0 492 697 | 12/1991 |

OTHER PUBLICATIONS

R. Castillo et al., *J. Catalysis 161* (1996) 524.

* cited by examiner

*Primary Examiner*—Cephia D. Toomer
(74) *Attorney, Agent, or Firm*—Kevin M. Carroll

(57) ABSTRACT

This invention is a method of purifying fuels containing organosulfur impurities. The fuel is oxidized with an organic hydroperoxide in the presence of an oxidation catalyst to form a sulfone product, followed by extraction of the sulfone product by solid-liquid or liquid-liquid extraction. The fuel is then contacted with a decomposition catalyst to remove the residual organic hydroperoxide from the fuel.

11 Claims, No Drawings

DESULFURIZATION PROCESS

FIELD OF THE INVENTION

This invention relates to a process for removing organosulfur impurites found in fuel streams. The process comprises oxidizing the organosulfur impurites by reaction with an organic hydroperoxide in the presence of a sulfur oxidation catalyst to produce sulfones, extracting the sulfones from the fuel stream, and then contacting the fuel stream with a Group 4 to 11 transition metal-containing decomposition catalyst in order to decompose the residual organic hydroperoxides in the fuel stream.

BACKGROUND OF THE INVENTION

Hydrocarbon fractions produced in the petroleum industry are typically contaminated with various sulfur impurities. These hydrocarbon fractions include diesel fuel and gasoline, including natural, straight run and cracked gasolines. Other sulfur-containing hydrocarbon fractions include the normally gaseous petroleum fraction as well as naphtha, kerosene, jet fuel, fuel oil, and the like. The presence of sulfur compounds is undesirable since they result in a serious pollution problem. Combustion of hydrocarbons containing these impurities results in the release of sulfur oxides which are noxious and corrosive.

Federal legislation, specifically the Clean Air Act of 1964 as well as the amendments of 1990 and 1999 have imposed increasingly more stringent requirements to reduce the amount of sulfur released to the atmosphere. The United States Environmental Protection Agency has lowered the sulfur standard for diesel fuel to 15 parts per million by weight (ppmw), effective in mid-2006, from the present standard of 500 ppmw. For reformulated gasoline, the current standard of 300 ppmw has been lowered to 30 ppmw, effective Jan. 1, 2004.

Because of these regulatory actions, the need for more effective desulfurization methods is always present. Processes for the desulfurization of hydrocarbon fractions containing organosulfur impurities are well known in the art. The most common method of desulfurization of fuels is hydrodesulfurization, in which the fuel is reacted with hydrogen gas at elevated temperature and high pressure in the presence of a costly catalyst. U.S. Pat. No. 5,985,136, for example, describes a hydrodesulfurization process to reduce sulfur level in naptha feedstreams. Organic sulfur is reduced by this reaction to gaseous $H_2S$, which is then oxidized to elemental sulfur by the Claus process. Unfortunately, unreacted $H_2S$ from the process is harmful, even in very small amounts. Although hydrodesulfurization readily converts mercaptans, thioethers, and disulfides, other organsulfur compounds such as substituted and unsubstituted thiophene, benzothiophene, and dibenzothiophene are difficult to remove and require harsher reaction conditions.

Because of the problems associated with hydrodesulfurization, research continues on other sulfur removal processes. For instance, U.S. Pat. No. 6,402,939 describes the ultrasonic oxidation of sulfur impurities in fossil fuels using hydroperoxides, especially hydrogen peroxide. These oxidized sulfur impurities may be more readily separated from the fossil fuels than non-oxidized impurities. Another method involves the desulfurization of hydrocarbon materials where the fraction is first treated by oxidizing the sulfur-containing hydrocarbon with an oxidant in the presence of a catalyst. U.S. Pat. No. 3,816,301, for example, discloses a process for reducing the sulfur content of sulfur containing hydrocarbons by oxidizing at least a portion of the sulfur impurities with an organic hydroperoxide such as tertiary butyl hydroperoxide in the presence of certain catalysts. The catalyst described is preferably a molybdenum-containing catalyst.

In sum, new methods to remove the sulfur compound impurities in hydrocarbon fractions are required.

SUMMARY OF THE INVENTION

This invention is a process for removing organosulfur impurites found in fuels. The process comprises contacting the fuel with an organic hydroperoxide in the presence of a sulfur oxidation catalyst to convert a substantial portion of the organosulfur impurities to sulfones. In this step, the organic hydroperoxide is converted into the corresponding alcohol on reaction with the organosulfur impurities. However, a residual amount of organic hydroperoxide typically remains after the oxidation step. The sulfones are then extracted from the fuel to form a purified fuel. The purified fuel is then contacted with a supported Group 4 to 11 transition metal catalyst to decompose the residual organic hydroperoxide in the fuel.

DETAILED DESCRIPTION OF THE INVENTION

The process of the invention comprises oxidizing organosulfur impurities found in fuels with an organic hydroperoxide in the presence of a sulfur oxidation catalyst. Any oxidation catalyst that oxidizes the organosulfur impurities to sulfones is sufficient. Sulfur oxidation catalysts are described in, for example, U.S. Pat. Nos. 3,565,793 and 3,816,301, the teachings of which are incorporated herein by reference. Suitable oxidation catalysts include soluble Group 4-6 transition metal such as compounds of titanium, zirconium, vanadium, chromium, and molybdenum (e.g., molybdenum hexacarbonyl). Suitable oxidation catalysts also include supported Group 4-6 transition metals that comprise a Group 4-6 transition metal and a support such as silica, alumina, clays, carbon, and the like.

Most preferably, the oxidation catalyst is a titanium-containing silicon oxide catalyst. Titanium-containing silicon oxide catalysts are well known and are described, for example, in U.S. Pat. Nos. 4,367,342, 5,759,945, 6,011,162, 6,114,552, 6,187,934, 6,323,147, European Patent Publication Nos. 0345856 and 0492697 and Castillo et al., *J. Catalysis* 161, pp. 524-529 (1996), the teachings of which are incorporated herein by reference in their entirety.

Such titanium-containing silicon oxide catalysts typically comprise an inorganic oxygen compound of silicon in chemical combination with an inorganic oxygen compound of titanium (e.g., an oxide or hydroxide of titanium). The inorganic oxygen compound of titanium is preferably combined with the oxygen compound of silicon in a high positive oxidation state, e.g., tetravalent titanium. The proportion of the inorganic oxygen compound of titanium contained in the catalyst composition can be varied, but generally the catalyst composition contains, based on total catalyst composition, at least 0.1% by weight of titanium with amounts from about 0.2% by weight to about 50% by weight being preferred and amounts from about 0.2% to about 10% by weight being most preferred.

One class of titanium-containing silicon oxide catalysts particularly suitable for the oxidation of organosulfur impurities is titania-on-silica (also sometimes referred to as "$TiO_2/SiO_2$"), which comprises titanium (titanium dioxide)

supported on silica (silicon dioxide). The titania-on-silica may be in either silylated or nonsilylated form.

The preparation of titania-on-silica catalysts may be accomplished by a variety of techniques known in the art. One such method involves impregnating an inorganic siliceous solid support with a titanium tetrahalide (e.g., $TiCl_4$), either by solution or vapor-phase impregnation, followed by drying and then calcination at an elevated temperature (e.g., 500° C. to 900° C.). Vapor-phase impregnation is described in detail in European Patent Pub. No. 0345856 (incorporated herein by reference in its entirety). U.S. Pat. No. 6,011,162 discloses a liquid-phase impregnation of silica using titanium halide in a non-oxygen containing solvent. In another technique, the catalyst composition is suitably prepared by calcining a mixture of inorganic siliceous solids and titanium dioxide at elevated temperature, e.g., 500° C. to 1000° C. Alternatively, the catalyst composition is prepared by cogelling a mixture of a titanium salt and a silica sol by conventional methods of preparing metal supported catalyst compositions.

The titanium-containing silicon oxide catalysts may optionally incorporate non-interfering and/or catalyst promoting substances, especially those which are chemically inert to the oxidation reactants and products. The catalysts may contain minor amounts of promoters, for example, alkali metals (e.g., sodium, potassium) or alkaline earth metals (e.g., barium, calcium, magnesium) as oxides or hydroxides. Alkali metal and/or alkaline earth metal levels of from 0.01 to 5% by weight based on the total weight of the titanium-containing silicon oxide catalyst composition are typically suitable.

The oxidation catalyst may be employed in any convenient physical form such as, for example, powder, flakes, granules, spheres or pellets.

The organosulfur oxidation process of the invention comprises contacting the fuel containing organosulfur impurities with an organic hydroperoxide in the presence of the oxidation catalyst. Suitable fuels include diesel fuel and gasoline, including natural, straight run and cracked gasolines. Other sulfur-containing fuels include the normally gaseous petroleum fraction as well as naphtha, kerosine, jet fuel, fuel oil, and the like. Diesel fuel is a particularly preferred fuel.

Preferred organic hydroperoxides are hydrocarbon hydroperoxides having from 3 to 20 carbon atoms. Particularly preferred are secondary and tertiary hydroperoxides of from 3 to 15 carbon atoms. Exemplary organic hydroperoxides suitable for use include t-butyl hydroperoxide, t-amyl hydroperoxide, cyclohexyl hydroperoxide, ethylbenzene hydroperoxide, and cumene hydroperoxide. T-butyl hydroperoxide is especially useful.

In such an oxidation process the organosulfur compound: hydroperoxide molar ratio is not particularly critical, but it is preferable to employ a molar ratio of approximately 2:1 to about 1:5.

The oxidation reaction is conducted in the liquid phase at moderate temperatures and pressures. Suitable reaction temperatures vary from 0° C. to 200° C., but preferably from 25° C. to 150° C. The reaction is preferably conducted at or above atmospheric pressure. The precise pressure is not critical. Typical pressures vary from 1 atmosphere to 100 atmospheres.

The oxidation reaction may be performed using any of the conventional reactor configurations known in the art for such oxidation processes. Continuous as well as batch procedures may be used. For example, the catalyst may be deployed in the form of a fixed bed or slurry.

The oxidation process of the invention converts a substantial portion of the organosulfur impurities into sulfones. Typically, greater than about 50 percent of the organosulfur impurities are converted into sulfones, preferably greater than about 80 percent, and most preferably greater than about 90 percent. The oxidation process of the invention also converts a substantial portion of the organic hydroperoxide to the corresponding alcohol. For instance, tertiary butyl alcohol results if tertiary butyl hydroperoxide is used as the organic peroxide. Typically, greater than about 50 percent of the organic hydroperoxide is converted into the corresponding alcohol, preferably greater than about 80 percent, and most preferably greater than about 90 percent. Following the oxidation of organosulfur impurities, a residual portion of the organic hydroperoxide typically remains in the fuel.

When a titanium-containing silicon oxide catalyst is used in the oxidation step of the process, the titanium-containing silicon oxide catalyst tends to slowly deteriorate in performance when used repeatedly or in a continuous process. The deterioration appears to be associated with the presence of organonitrogen impurities in the fuel itself. Removal of the organonitrogen impurities prior to the oxidation step is therefore a preferred embodiment of the process of the invention. Prior to oxidation of the organosulfur impurities, the fuel may be subjected to an organonitrogen removal step. The removal of organonitrogen impurities from fuels may be accomplished by extraction techniques. Purification by extraction methods is well-known in the art. Suitable extraction methods include, but are not limited to, solid-liquid extractions using adsorbents and liquid-liquid extractions using polar solvents.

If organonitrogen extraction is employed, the extraction step removes at least 50 percent of the nitrogen content from the fuel. Preferably, more than about 70 percent of the nitrogen content in the fuel is removed by extraction. After isolation of the fuel having a reduced amount of organonitrogen impurities, the fuel may then be subject to oxidation.

When the oxidation has proceeded to the desired extent, the product mixture may be treated using an extraction process to remove the sulfones from the fuel. Any viable extraction process, such as liquid-liquid or solid-liquid extraction, may be used.

The sulfone removal step may be conducted by solid-liquid or liquid-liquid extraction. The sulfones may be removed from the fuel by solid-liquid extraction with at least one solid adsorbent. The adsorbents useful in the invention include any adsorbent capable of removing the sulfones from fuels. Useful adsorbents include clays, inorganic oxides such as aluminum oxides, silicon oxides, silica-aluminas, zeolitic materials such as zeolite Y, Zeolite X, ZSM-5, and mixtures thereof. Mixtures of the adsorbents may also be employed. Particularly useful adsorbents include silicas, aluminas, and silica-aluminas.

The adsorptive contact is conveniently carried out at temperatures in the range of about 15° C. to 90° C., preferably 20° C. to 40° C. The flow rates are not critical, however flow rates of about 0.5 to 10 volumes of the fuel per volume of adsorbent per hour are preferred, with a flow rate of about 1 to 5 volumes particularly preferred. It is generally preferred to employ more than one adsorbent contact beds so that a depleted bed can be regenerated while a fresh bed is used. Regeneration can be accomplished by first draining the fuel, and washing the adsorbent bed with a hydrocarbon solvent or solvent mixture such as heptane to remove the residual fuel from the adsorbent. The fuel may be recovered from the hydrocarbon solvent by any method such as evaporation of the hydrocarbon solvent. The adsorbent bed is then washed with a polar solvent or solvent mixture such as water, methanol, or other solvents, followed by drying or by stripping with a heated inert gas such as steam, nitrogen or the like. The polar solvent of solvent mixture may be recovered, by, e.g., distillation, for reuse in regeneration.

If a solid-liquid extraction process is used to remove sulfones, it is preferable to remove the alcohol product of the oxidation step prior to the solid-liquid sulfone extraction process. The alcohol may be removed by any conventional technique, such as simple distillation and/or stripping the fuel after oxidation with a gas such as carbon dioxide or nitrogen. The alcohol may also be separated from the fuel by a liquid-liquid extraction step in which the fuel is contacted with a polar solvent such as water or an alcohol (such as methanol) that is immiscible with the fuel.

In a typical liquid-liquid extraction process, an impure stream is contacted with an extraction liquid. The extraction liquid is immiscible with and has a different (usually lower) density than the impure stream. The mixture is intimately mixed by any of a variety of different techniques. During the intimate mixing, the impurity passes from the impure stream into the extraction liquid, to an extent determined by the so-called partition coefficient of such substance in the conditions concerned. Extraction processes may be operated batch-wise or continuously. The impure stream may be mixed with an immiscible extraction liquid in an agitated vessel, after which the layers are settled and separated. The extraction may be repeated if more than one contact is required. Most extraction equipment is continuous, with either successive stage contacts or differential contacts. Typical liquid extraction equipment includes mixer-settlers, vertical towers of various kinds which operate by gravity flow, agitated tower extractors, and centrifugal extractors.

The liquid-liquid extraction embodiment of the invention comprises contacting the fuel containing sulfones with a polar solvent. Any polar solvent that is immiscible and having a different density than the fuel may be used. Particular preferred polar solvents are selected from the group consisting of alcohol, ketone, water, and mixtures thereof. The alcohol may be any alcohol that is immiscible with the fuel, and is preferably a $C_1$-$C_4$ alcohol, most preferably methanol. The ketone may be any ketone that is immiscible with the fuel, and is preferably a $C_3$-$C_8$ aliphatic ketone, such as acetone and methyl ethyl ketone, or mixtures of ketones containing acetone. Especially preferred solvents include mixtures of alcohol and water, most preferably a methanol-water mixture. When alcohol-water mixtures are used as the extraction solvent, the mixture preferably comprises about 0.5 to about 50 weight percent water, most preferably from about 1 to about 10 weight percent water. The solvent:fuel ratio is not critical but preferably is from about 10:1 to about 1:10.

Following sulfone removal, the fuel will still typically contain a residual portion of organic hydroperoxide. The organic hydroperoxide is not a desirable component in fuels as its presence may result in decreased fuel stability. The decomposition step comprises contacting the fuel having a reduced amount of sulfones and containing residual organic hydroperoxide with a decomposition catalyst, wherein the residual organic hydroperoxide is converted mainly into the corresponding alcohol.

The decomposition catalyst is a Group 4 to 11 transition metal-containing catalyst. The decomposition catalyst may be any solid catalyst that removes the residual organic hydroperoxide from the fuel. Preferably, the decomposition catalyst comprises a Group 4 to 11 transition metal and a support. The support is preferably a porous material. Supports are well-known in the art. There are no particular restrictions on the type of support that are used. For instance, the support can be inorganic oxides, inorganic chlorides, carbon, and organic polymer resins. Preferred inorganic oxides include oxides of Group 2, 3, 4, 5, 6, 13, or 14 elements. Particularly preferred inorganic oxide supports include silica, alumina, titania, zirconia, niobium oxides, tantalum oxides, molybdenum oxides, tungsten oxides, amorphous titania-silica, amorphous zirconia-silica, amorphous niobia-silica, and the like. Preferred organic polymer resins include polystyrene, polystyrene-divinylbenzene copolymers, crosslinked polyethyleneimines, and polybenzimidizole. Suitable supports also include organic polymer resins grafted onto inorganic oxide supports, such as polyethylenimine-silica. Preferred supports also include carbon. Particularly preferred supports include carbon, silica, alumina, and silica-aluminas. The support may also include the Group 4-11 transition metal.

Preferably, the support has a surface area in the range of about 10 to about 700 $m^2/g$, more preferably from about 50 to about 500 $m^2/g$, and most preferably from about 100 to about 400 $m^2/g$. Preferably, the pore volume of the support is in the range of about 0.1 to about 4.0 mL/g, more preferably from about 0.5 to about 3.5 mL/g, and most preferably from about 0.8 to about 3.0 mL/g. Preferably, the average particle size of the support is in the range of about 0.1 to about 10,000 μm, more preferably from about 1 to about 5,000 μm, and most preferably from about 10 to about 500 μm. The average pore diameter is typically in the range of about 10 to about 1000 Å, preferably about 20 to about 500 Å, and most preferably about 50 to about 350 Å.

The decomposition catalyst also contains a Group 4 to 11 transition metal, preferably a Group 4 to 9 transition metal. While any of the Group 4 to 11 transition metals can be utilized (e.g., titanium, zirconium, vanadium, chromium, molybdenum, manganese, rhenium, iron, ruthenium, cobalt, nickel, palladium, copper), either alone or in combination, chromium, titanium, iron, ruthenium, and cobalt are preferred. Chromium, titanium, and iron are especially preferred. Typically, the amount of transition metal present in the supported catalyst will be in the range of from 0.01 to 20 weight percent, preferably 0.1 to 10 weight percent. The manner in which the transition metal is incorporated into the supported catalyst is not considered to be particularly critical. For example, the transition metal may be supported on the support by impregnation, adsorption, ion-exchange, precipitation, or the like. The Group 4 to 11 transition metal may also be incorporated into the framework of an inorganic oxide support material. For example, the transition metal may be incorporated into a silica framework with in MFI and MCM structures such as TS-1, Ti-beta, and the like.

The Group 4 to 11 transition metal-containing decomposition catalyst may also be a solid inorganic compound of a Group 4 to 11 transition metal, such as titanium oxide, tungsten oxide, iron oxide, molybdenum chloride, manganese hydroxide, nickel carbide, and the like.

The decomposition catalyst may be optionally thermally treated in a gas such as nitrogen, helium, vacuum, hydrogen, oxygen, air, or the like. The thermal treatment temperature is typically from about 50 to about 900° C. The decomposition catalyst may additionally comprise a binder or the like and may be molded, spray dried, shaped or extruded into any desired form prior to use.

For the organic hydroperoxide decomposition step of the invention, the catalyst is preferably in the form of a suspension or fixed-bed. The process may be performed using a continuous flow, semi-batch or batch mode of operation. It is advantageous to work at a pressure of 1-100 bars. Decomposition according to the invention is carried out at a temperature effective to achieve the desired reduction in organic hydroperoxide, preferably at temperatures in the range of 0-250° C., more preferably, 20-150° C.

A fuel product is produced by the process of the invention.

The following examples merely illustrate the invention. Those skilled in the art will recognize many variations that are within the spirit of the invention and scope of the claims.

EXAMPLE 1

Oxidation of Sulfur Impurities in Diesel Fuel

Chevron/Phillips diesel containing 30 ppm N and 380 ppm S is tested in a continuous oxidation run using a titania-on-silica catalyst synthesized as described below. The diesel is pretreated by passing the diesel over an alumina bed to remove organonitrogen impurities so that the nitrogen content of fuel is less than 7 ppm N.

A reaction mixture of 99% diesel fuel (plus toluene) and 1% Lyondell TBHP oxidate (containing approximately 43 wt. % TBHP and 56 wt. % tertiary butyl alcohol) is fed to a fixed-bed reactor containing titania-on-silica catalyst (50 cc, 21 g) at a liquid hourly space velocity of 3 $hr^{-1}$, a temperature of 80° C. The diesel is fed to the reactor at 150 cc/hr. A 1:1 mixture of toluene:TBHP oxidate is fed to the reactor at 3 cc/hr. The sulfur content after oxidation and removal of sulfones by alumina adsorption for the first 2 weeks of operation is less than 12 ppm S. The diesel fuel contained approximately 2000 ppm TBHP.

EXAMPLE 2

Decomposition of Residual TBHP

The treated diesel fuel of Example 1 was contacted with two supported chromium catalysts in separate runs. Catalyst A contained 1.0 wt. % Cr on silica gel (surface area=501 m2/g). Catalyst B contained 1.0 wt. % Cr and 2.56 wt. % Ti on silica gel (surface are=505 m2/g). The diesel fuel was contacted with Catalyst A at 120° C. for 30 minutes and with Catalyst B at 80° C. for 30 minutes. Both runs resulted in 100% conversion of TBHP and no visual degradation of the diesel fuel samples.

In contrast, attempts to thermally decompose the residual TBHP by heating the diesel fuel with no catalyst present at 180° C. for 15 minutes results in little if any TBHP conversion. This run also resulted in significant hydrocarbon degradation.

We claim:

1. A process comprising:

(a) contacting a fuel containing organosulfur impurities with an organic hydroperoxide in the presence of an oxidation catalyst to form an oxidized fuel, wherein a substantial portion of the organosulfur impurities are converted into sulfones and a residual amount of organic hydroperoxide remains in the oxidized fuel;

(b) extracting the sulfones from the oxidized fuel to form a fuel having a reduced amount of sulfones and a residual amount of organic hydroperoxide; and (c) contacting the fuel from step (b) with a Group 4 to 11 transition metal-containing decomposition catalyst at a temperature in the range of 20 to 150° C.

2. The process of claim 1 wherein the organic hydroperoxide is tertiary butyl hydroperoxide.

3. The process of claim 1 wherein the oxidation catalyst is a titanium-containing silicon oxide catalyst.

4. The process of claim 1 wherein the sulfones are extracted by solid-liquid extraction using at least one sulfone adsorbent.

5. The process of claim 1 wherein the sulfones are extracted by liquid-liquid extraction using at least one polar solvent selected from the group consisting of a $C_1$-$C_4$ alcohol, a $C_3$-$C_8$ ketone, water, and mixtures thereof.

6. The process of claim 5 wherein the polar solvent is a mixture of methanol and water.

7. The process of claim 1 wherein the Group 4 to 11 transition metal-containing decomposition catalyst comprises a Group 4 to 11 transition metal and a support.

8. The process of claim 7 wherein the Group 4 to 11 transition metal is selected from the group consisting of chromium, titanium, manganese, vanadium, iron, ruthenium, cobalt, and mixtures thereof.

9. The process of claim 7 wherein the Group 4 to 11 transition metal is selected from the group consisting of chromium, titanium, iron, and mixtures thereof.

10. The process of claim 7 wherein the support is selected from the group consisting of silicas, aluminas, silica-aluminas, and carbon.

11. The process of claim 7 wherein the decomposition catalyst comprises chromium, silica, and optionally titanium.

* * * * *